United States Patent [19]

Woods et al.

[11] Patent Number: 4,729,391

[45] Date of Patent: Mar. 8, 1988

[54] MICROPOROUS MATERIALS IN CIGARETTE FILTER CONSTRUCTION

[75] Inventors: Donna K. Woods; Donald L. Roberts, both of Winston-Salem, N.C.

[73] Assignee: R. J. Reynolds Tobacco Company, Winston-Salem, N.C.

[21] Appl. No.: 798,227

[22] Filed: Nov. 14, 1985

[51] Int. Cl.[4] ..... A24D 3/08; A24D 3/14

[52] U.S. Cl. ..... 131/332; 131/335

[58] Field of Search ..... 131/335, 332, 361

[56] References Cited

U.S. PATENT DOCUMENTS

| | | | |
|---|---|---|---|
| 3,939,849 | 2/1976 | Baxter et al. | 131/332 |
| 4,002,177 | 1/1977 | Rainer et al. | 131/332 |
| 4,281,671 | 8/1981 | Bynre et al. . | |
| 4,282,890 | 8/1981 | Howell, Jr. et al. | 131/332 |

FOREIGN PATENT DOCUMENTS

| | | | |
|---|---|---|---|
| 1928949 | 12/1965 | Fed. Rep. of Germany | 131/332 |
| 2404959 | 8/1974 | Fed. Rep. of Germany | 131/332 |

*Primary Examiner*—Millin V.
*Assistant Examiner*—H. Macey

[57] ABSTRACT

Flavor-carrying microporous polymer material is incorporated with a cigarette filter to release flavor into the smoke-stream during smoking of the cigarette.

2 Claims, No Drawings

MICROPOROUS MATERIALS IN CIGARETTE FILTER CONSTRUCTION

TECHNICAL FIELD

This invention pertains to improved smoking articles in general and cigarettes in particular. More particularly, the invention pertains to improved cigarette filters.

BACKGROUND OF THE INVENTION

Various techniques have been used in the past for improving the efficiency of cigarette filters for removal of particulate matter from the smoke aerosol produced by burning cigarette tobacco without also removing an excess amount of flavors. Other techniques have been employed for dispensing flavoring materials from cigarette filters such as, for example, dissolving flavorants in the plasticizer for the filter tow and incorporating encapsulated flavors into the filter as it is being made. The variety of techniques has met with varying degrees of success, but each has left something to be desired.

SUMMARY OF THE INVENTION

An object of the present invention is to provide a cigarette filter which simultaneously removes particulate matter from smoke and replaces it with desirable flavor materials.

Another object is to provide an improved cigarette filter which is easily produced by existing cigarette filter making equipment with only minor modifications.

Still another object is to provide a more satisfying cigarette with improved flavor delivery from the first puff to the last.

Still other objects will be apparent from the more detailed description of the invention which follows.

In accordance with the present invention, these and other objectives are accomplished by incorporating flavor-carrying microporous materials into the cigarette filter. The microporous materials suitable for use in the present invention include thermoplastic polymers which have been processed to produce an open-cell structure of communicating cells and pores. The average size of the cells in the structure normally ranges from about 0.5 to about 150 microns with from about 1 to about 30 being typical. The size of the pores which connect the cells is in the range of about 0.01 to about 10 microns, typically about 0.1 to 5 microns. Thus, when a range of pore size is given herein it is meant that both cells and connecting pores are within the overall size range of 0.01 to 150 microns.

Examples of microporous polymer materials for use in the present invention include microporous polyethylene, microporous polypropylene, microporous cellulose acetate and various microporous polymers prepared from polyolefins, copolymers, condensation polymers and polymer blends. The microporous polymer may be in the form of film, sheet, beads, random-sized particles, filaments, fibers, extruded foamed rods, etc. When the microporous material is in particulate form, it is preferred that the particle size be in the range of 0.01 to 2.0 millimeters.

In carrying out the present invention, flavoring materials, such as menthol for example, are caused to be adsorbed by the microporous material which is then incorporated into the filter and then the filter is attached to a tobacco rod to form a filter cigarette. During smoking of the cigarette, particulate material from the smoke is preferentially adsorbed by the microporous material causing the flavorant to be displaced or eluted by the smoke aerosol for delivery to the smoker.

A distinct advantage of the present invention is that the flavorant is held within the filter until it is displaced by substances from the tobacco smoke, thus inhibiting losses by migration of flavor materials throughout the cigarette pack during storage, yet the flavorant is readily dispensed at the desired time and in the desired amount, i.e., during puffing of the cigarette during smoking. Puffing of an unlit cigarette does not release an appreciable amount of flavorant, but rather flavorant release is proportional to the flow of smoke to the filter; therefore, better control of flavor release is achieved by the present invention than by any other known practical means.

DETAILED DESCRIPTION OF THE INVENTION

The present invention provides a filter cigarette which delivers flavor to the smoker in addition to the flavors provided by the tobacco itself. This is accomplished by including with the filter a microporous material into which flavorants have been adsorbed for release into the smoke stream during smoking of the cigarette. Suitable microporous materials include those prepared from polyolefins, copolymers, condensation polymers, and polymer blends. Such microporous polymers are known and can be used in fiber, particulate or sheet form. Examples include microporous polyethylene prepared according to U.S. Pat. No. 3,839,516, microporous polypropylene available from Celanese Corporation under the tradename CELGUARD®, and a microporous thermoplastic polymer material made by Armak Company, a division of Akzona, Incorporated, sold under the tradename ACCUREL® (see U.S. Pat. No. 4,247,498). Microporous polyethylene in particulate or sheet form is a preferred material.

Suitable volatile flavorants for use in accordance with the present invention include the following which may be used alone or in admixture: menthol, vanillin, phenylacetic acid and its esters, solanone, megastigmatrienones, damascenone, short chain fatty acids and esters, essential oils, pyrazine derivatives, cinnamic acid and its esters, terpene derivatives, sesquiterpene derivatives, commercial tobacco flavors, nootkatone, maltol. The preferred amount of flavorant in the microporous filter material is in the range of 0.01 to 6.0 weight percent of the material.

The invention is further illustrated by the following Examples:

EXAMPLE 1

Cigarettes were constructed which used filters made from strips of microporous polypropylene sheet material obtained from Celanese Corporation under the tradename Celguard®. The sheet was 1.0 mil thick and had a pore size in the range of 0.02 to 0.04 microns. The filters were made from strips having a width equal to the desired filter length by folding them back and forth until a cylinder of the desired firmness and about 27 mm. long was formed and then wrapping it with plug wrap. Filters having a draft resistance (pressure drop) in the range of 60 to 150 mm. of water at a flow rate of 17.5 cc/sec. were selected for testing and attached to conventional tobacco rods with tipping paper in the conventional manner to make cigarettes. The cigarettes were smoked under FTC smoking conditions and the WTPM (wet total particulate matter) collected on the filter was measured by weighing the microporous filter material before and after smoking. An increase of 25% in weight of the filter was obtained, demonstrating that the microporous filter material effectively adsorbed substances from the cigarette smoke.

EXAMPLE 2

Microporous polypropylene sheet, like that used in Example 1, was treated by immersing it in a solution of 10% menthol in ethyl alcohol and air dried in ambient air. Cigarettes were constructed in which this sheet was made into filters 10 mm. long as in Example 1 and placed in axial alignment with filter plugs 17 mm. long made of unflavored cellulose acetate fibers. A full flavor commercial blended tobacco rod was attached with tipping paper to these filters with the cellulose acetate filter plug at the mouth end for smoking by a panel of smokers. All smokers detected the presence of menthol in the mainstream smoke of the cigarettes. Organoleptic examination of the filters after smoking indicated that some menthol was still present in the filter after smoking of the cigarette.

EXAMPLE 3

Microporous polyethylene sheet 1 mil thick prepared according to U.S. Pat. No. 3,839,516 was treated as in the previous example with menthol solution, air dried, folded into a suitable-sized piece and inserted into the cavity of a cigarette filter. When these cigarettes were smoked, a pleasant level of menthol perception was noted which continued throughout smoking of the cigarette.

EXAMPLE 4

Strips of microporous polymer sheet material 1 mil thick were sprayed until wet with solutions of various flavorants, air dried and used as plug wrap for cellulose acetate filters to evaluate flavor delivery. A mentholated microporous polyethylene film was wrapped around a cellulose acetate filter rod and this was then attached to a tobacco rod with non-perforated tipping. Panelists smoked these cigarettes and observed good delivery of menthol in the mainstream smoke. The menthol taste was strongest in the initial puffs and after smoking the cigarette there was a good fresh aftertaste indicative of the continued delivery of the menthol flavor.

A vanillin-flavored microporous polyethylene film was tested similar to the menthol. Two thirds of the panelists detected the sweet vanilla-like flavor while smoking the cigarettes.

Additional flavors tested include apple, chocolate, vanilla flavor and wintergreen. The microporous polypropylene sheets were treated by immersion in alcoholic solutions of the chocolate, vanilla and wintergreen flavors. The apple flavor was made up in aqueous solution and the sheets immersed in that solution. Following immersion the sheets were removed and hung up in the room to air dry. Cigarettes were assembled as previously described and smoked by panelists. The flavors were identified by the smokers with the exception of the apple which was noted as vanilla-like and the best tasting.

EXAMPLE 5

A cigarette filter was constructed in which microporous polypropylene sheet 1 mil thick and having an average pore size of 0.04 microns was used as the plug wrap after being flavored with menthol as described in the previous example and the filter attached to a tobacco rod with tipping paper. The filter was then perforated by needles passing through the tipping paper and the plug wrap to provide air dilution to the cigarette. Surprisingly, these cigarettes when compared with the non-perforated product gave increased menthol perception to the smoker.

What is claimed is:

1. An improved filter cigarette comprising a tobacco rod having a filter attached thereto, wherein said filter comprises filter tow wrapped with a sheet of microporous polymer having flavorant adsorbed therein for release into the smoke stream during smoking of the cigarette.

2. The cigarette of claim 1 wherein the filter is provided with means to admit dilution air.

* * * * *